US009243443B2

(12) United States Patent
Nea

(10) Patent No.: US 9,243,443 B2
(45) Date of Patent: Jan. 26, 2016

(54) SPACERS FOR INSULATED GLASS

(71) Applicant: Rey Nea, Mira Loma, CA (US)

(72) Inventor: Rey Nea, Mira Loma, CA (US)

( * ) Notice: Subject to any disclaimer, the term of this patent is extended or adjusted under 35 U.S.C. 154(b) by 0 days.

(21) Appl. No.: 14/725,951

(22) Filed: May 29, 2015

(65) Prior Publication Data

US 2015/0343743 A1 Dec. 3, 2015

Related U.S. Application Data

(63) Continuation of application No. 14/506,578, filed on Oct. 3, 2014, now Pat. No. 9,074,416.

(60) Provisional application No. 62/005,748, filed on May 30, 2014.

(51) Int. Cl.
*E06B 3/663* (2006.01)
*E06B 3/673* (2006.01)

(52) U.S. Cl.
CPC ..... *E06B 3/67347* (2013.01); *E06B 3/66342* (2013.01); *E06B 3/6733* (2013.01)

(58) Field of Classification Search
CPC ..... E06B 3/6733; E06B 3/67347; E06B 3/67352; E06B 3/66304; E06B 3/66309; E06B 3/663; E06B 3/67326; E06B 3/66323; E06B 3/66342; E06B 2003/6638; E06B 2003/6639
USPC ..... 52/786.13, 172; 156/107, 109; 428/34
See application file for complete search history.

(56) References Cited

U.S. PATENT DOCUMENTS 3,957,406 A * 5/1976 Battersby ..... 425/87
4,411,115 A * 10/1983 Marzouki et al. ..... 52/309.1
4,431,691 A * 2/1984 Greenlee ..... 428/34
4,745,711 A 5/1988 Box
5,270,091 A 12/1993 Krysiak et al.
5,773,135 A 6/1998 LaFond
5,813,191 A 9/1998 Gallagher (Continued)

FOREIGN PATENT DOCUMENTS

EP 0500483 B1 8/1995
JP 59078957 A * 5/1984

(Continued)

OTHER PUBLICATIONS

S. Van Den Bergh et al., "Window Spacers and Edge Seals in Insulating Glass Units: A State-of-the-Art Review and Future Perspectives," Ernest Orlando Lawrence Berkeley National Laboratory, Energy and Buildings 58 (2013) 263-280; http://dx.doi.org/10.1016/j.enbuild.2012.10.006.

(Continued)

*Primary Examiner* — Robert Canfield
(74) *Attorney, Agent, or Firm* — Laura M. Lloyd; Leech Tishman Fuscaldo & Lampl

(57) ABSTRACT

This invention provides a sealing spacer for spacing apart two window panes to form a window assembly. The spacer has an elongated, flexible strip having opposed edge surfaces and opposed side surfaces. The opposed edge surfaces undulate with crests and troughs. The spacer has an activatable sealant for directly sealingly securing the flexible strip to each of the two window panes. The activatable sealant is on each of the opposed side surfaces of the flexible strip, and extends into at least a portion of the opposed side surfaces of the flexible strip. The invention also provides methods for making the spacer and window assembly.

4 Claims, 10 Drawing Sheets

(56) References Cited

U.S. PATENT DOCUMENTS

| | | | | |
|---|---|---|---|---|
| 5,851,609 | A | 12/1998 | Baratuci et al. | |
| 6,131,364 | A | 10/2000 | Peterson | |
| 6,351,923 | B1 | 3/2002 | Peterson | |
| 6,355,328 | B1 | 3/2002 | Baratuci et al. | |
| 6,401,428 | B1 | 6/2002 | Glover et al. | |
| 6,405,498 | B1 | 6/2002 | Riegelman | |
| 6,434,910 | B1 | 8/2002 | Deane | |
| 6,581,341 | B1 | 6/2003 | Baratuci et al. | |
| 6,877,292 | B2 | 4/2005 | Baratuci et al. | |
| 7,107,729 | B2 | 9/2006 | Baratuci et al. | |
| 7,493,739 | B2 | 2/2009 | Baratuci et al. | |
| 7,877,958 | B2 | 2/2011 | Baratuci et al. | |
| 8,230,661 | B2 | 7/2012 | Baratuci et al. | |
| 8,281,527 | B2 | 10/2012 | Baratuci et al. | |
| 8,776,350 | B2 | 7/2014 | Cooper | |
| 2004/0079047 | A1 | 4/2004 | Peterson | |
| 2005/0227025 | A1* | 10/2005 | Baratuci et al. | 428/34 |
| 2009/0223150 | A1* | 9/2009 | Baratuci et al. | 52/204.593 |
| 2012/0304591 | A1* | 12/2012 | Cooper | 52/786.13 |

FOREIGN PATENT DOCUMENTS

| | | | |
|---|---|---|---|
| WO | WO97/26634 | A1 | 7/1997 |
| WO | WO 9726434 | A1 * | 7/1997 |

OTHER PUBLICATIONS

*Quanex IG Systems, Inc*. vs. *ATN Holding Inc. et al*., Complaint for Patent Infringement and Exhibits A-E, Case No. 5:14-cv-02290, filed with the United States District Court, Central District of California on Nov. 6, 2014, pp. 1-67.

*ATN Holding Inc. et al*. vs. *Quanex IG Systems, Inc*., First Amended Complaint for Declaratory Relief and Request for Jury Trial and Exhibits A-J, Case No. 5:14-cv-01860-ODW-SP, filed with the United States District Court, Central District of California on Jan. 8, 2015, pp. 1-127.

Nea, Rey, First Office Action on the Merits issued in parent U.S. Appl. No. 14/506,578, United States Patent and Trademark Office, Nov. 25, 2014, 14 pages.

Nea, Rey, Final Office Action on the Merits issued in parent U.S. Appl. No. 14/506,578, United States Patent and Trademark Office, Mar. 12, 2015, 7 pages.

*ATN Holding Inc. et al*. vs. *Quanex IG Systems, Inc*., First Amended Complaint for Declaratory Relief and Request for Jury Trial and Exhibits A-J, Case No. 5:14-cv-01860-ODW-SP, filed with the United States District Court, Central District of California on Jan. 8, 2015, pp. 1-137.

* cited by examiner

SPACERS FOR INSULATED GLASS

CROSS-REFERENCE TO RELATED APPLICATION

The present Application is a continuation of U.S. patent application Ser. No. 14/506,578 titled "Spacers for Insulated Glass" filed Oct. 3, 2014, which claims the benefit of U.S. Provisional Patent Application No. 62/005,748, titled "Spacers for Insulated Glass," filed May 30, 2014, the contents of which are incorporated in this disclosure by reference in their entirety.

BACKGROUND

Insulated windows are assembled by spacing two layers of glass in a fixed relationship. The layers of glass are fixed together at the outer edges of the glass with a removable or permanent spacer plus a sealant, or a structure that contains both a sealant and spacer. The layers of glass are sealed together, forming a sandwich structure that contains the sealant and/or spacer between the glass layers. There is also a sealed air pocket between the two glass layers.

The formation of a window assembly requires multiple steps when a removable spacer is used. First, the spacer must be placed between the glass layers. Second, the sealant is injected at the edges of the glass. Third, the sealant is cured. Fourth, the spacer is removed. This process is labor intensive and requires expensive equipment.

In contrast, when a permanent spacer is used, an adhesive is applied to secure the permanent spacer between the two pieces of glass. The spacer is then set in place, followed by injection of a sealant between the spacer and the edges of the sheets of glass. This process is also labor intensive.

An alternative method of manufacturing insulated windows uses a unitary structure containing both a sealant and spacer. Sealant and spacer structures that are currently used are made of a flexible, hollow metal material which has a support structure that is folded over the two edges and one side of the hollow metal material, as in U.S. Pat. Nos. 4,431,691 and 8,230,661. This support structure has many disadvantages, including increased manufacturing costs for materials and labor. Additionally, the presence of a support structure makes the spacer rigid and hard to bend to allow a 90 degree angle to be formed at the corners of a window assembly. Another disadvantage of spacers with a support structure is that there is no support within the hollow metal material, which may cause the spacer to fail when a lot of pressure is applied to the objects they are spacing apart.

SUMMARY

There is a need for a window assembly system with a spacer that functions as a unitary sealant and spacer for window panes without a support structure. This system has many advantages; for example, the spacer of the present invention costs less in materials and labor to manufacture, and allows for more flexibility in forming the corners of a window assembly.

The present invention is directed, in part, to a system containing a sealing spacer for spacing apart two window panes. The spacer has an elongated, flexible strip having opposed edge surfaces and opposed side surfaces which undulate with crests and troughs. The spacer also comprises an activatable sealant for directly sealingly securing the flexible strip to each of the two window panes, wherein the activatable sealant is on each of the opposed side surfaces of the flexible strip, and extends into at least a portion of the opposed side surfaces of the flexible strip. The activatable sealant extends from about 0.1 to about 4 mm into a portion of the opposed side surfaces of the flexible strip. Preferably, the activatable sealant extends at least about 1 mm into a portion of the opposed side surfaces of the flexible strip.

The spacer can also have a substantially flat strip adhered to the crests of one opposed edge surface of the flexible strip. The substantially flat strip can be metal such as aluminum. The substantially flat strip can also contain a desiccant.

The invention is also directed to a window assembly comprising two window panes sealingly secured by the spacer.

A method for forming a spacer for spacing apart two window panes is described, the method comprising the steps of (a) extruding an activatable sealant on a first and second opposed side surfaces of a flexible strip, (b) activating the activatable sealant, whereby the activation causes the activatable sealant to extend into at least a portion of the opposed side surfaces of the flexible strip, and (c) extruding a desiccant on one edge of the flexible strip. In one embodiment, the step of activating the activatable sealant comprises heating the activatable sealant to at least 70° C. and applying pressure of at least 0.1 kilograms per square meter. In another embodiment, the step of activating the activatable sealant comprises applying pressure of at least 0.1 kilograms per square meter to the activatable sealant. In yet another embodiment, the step of activating the activatable sealant comprises applying a temperature of at least 70° C. to the activatable sealant. In an additional embodiment, after step (b), a second portion of the activatable sealant is placed on the opposed side surfaces of the flexible strip in contact with the first portion of the activatable sealant.

The invention is also directed to a spacer for spacing apart two window panes comprising an elongated flexible strip having opposed edge surfaces and opposed side surfaces, wherein the opposed edge surfaces undulate with crests and troughs, and an activatable sealant for directly sealingly securing the flexible strip to each of the two window panes, wherein the activatable sealant is on each of the opposed side surfaces of the flexible strip, and extends into at least a portion of the opposed side surfaces of the flexible strip. A substantially flat strip is adhered to the crests of one edge surface of the flexible strip, and a layer of desiccant is adhered to the substantially flat strip. In one embodiment, the activatable sealant extends from about 0.1 to about 3 mm into the opposed side surfaces of the flexible strip. In another embodiment, the activatable sealant extends at least about 1 mm into the opposed side surfaces of the flexible strip.

The invention is also directed to a window assembly comprising a spacer assembly for spacing apart two window panes. The spacer assembly has an elongated flexible strip having opposed edge surfaces and opposed side surfaces, wherein the opposed edge surfaces undulate with crests and troughs, and an activatable sealant for directly sealingly securing the flexible strip to each of the two window panes. The activatable sealant is on each of the opposed side surfaces of the flexible strip, and extends into at least a portion of the opposed side surfaces of the flexible strip. The window assembly also has two window panes sealingly adhered to the opposed edge surfaces of the spacer by the activatable sealant. In one embodiment, the window panes comprise glass panes.

A method for making the window assembly is described. The method comprises the steps of placing a first side of a spacer on a first window pane, (b) placing a second window pane on a second side of the spacer, and (c) sealingly securing the first and second spacer sides to the first and second window pane by heating the sealant to at least 70° C. and applying pressure of at least 0.1 kilograms per square meter.

DRAWINGS

These and other features, aspects, and advantages of the present invention will become better understood with regard to the following description, appended claims, and accompanying drawings:

DESCRIPTION

Definitions

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

An "activatable sealant" is a sealant that adheres to an object or elongated flexible strip or substantially flat strip by the application of pressure, elevated temperature, or a combination of pressure and elevated temperature.

As used herein, the term "comprise" and variations of the term, such as "comprising" and "comprises," are not intended to exclude other additives, components, integers or steps.

A "desiccant" is a material that functions to minimize the effects of moisture. The desiccant prevents moisture from condensing on the interior surface of the window assembly. A desiccant can be part of the spacer, sealant, or spacer/sealant structure.

As used herein the term "sealingly secure" means an activatable sealant that is able to form an air-tight seal with a second material.

Spacer

The present invention is directed, in part, to a window assembly system containing a spacer for spacing apart transparent or translucent materials such as glass and plastic window panes.

In contrast to spacers used in prior window assemblies, the spacer of the present invention functions as a unitary sealant and spacer without the need for a support structure. The present invention has many advantages over the currently used spacers; for example, the spacer of the present invention costs less in materials and labor to manufacture, and allows for more flexibility in forming the corners of a window assembly.

Figure 1:
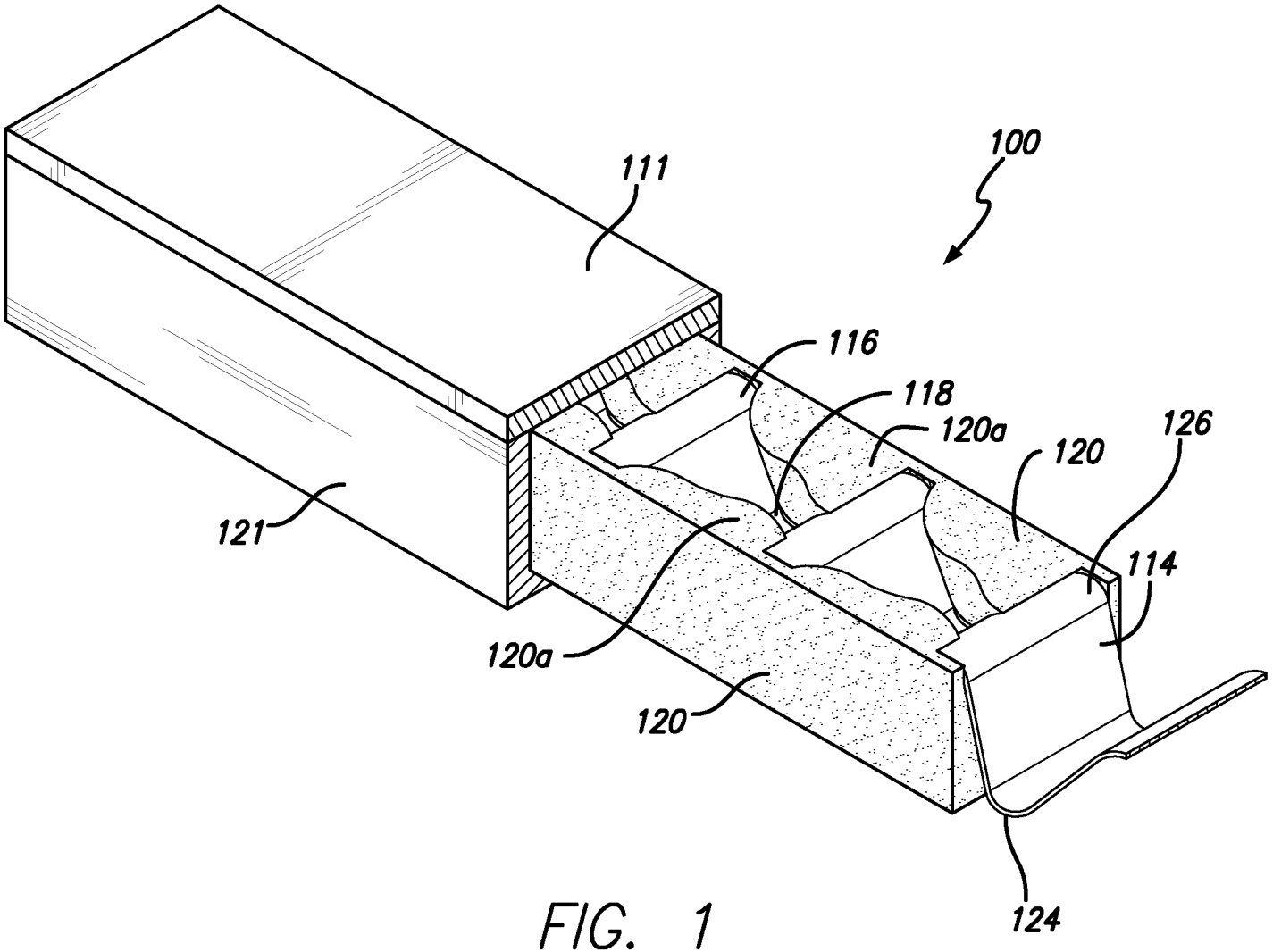
FIG. 1 is a partially broken top perspective view of a first version of a spacer having features of the present invention.
Figure 2:
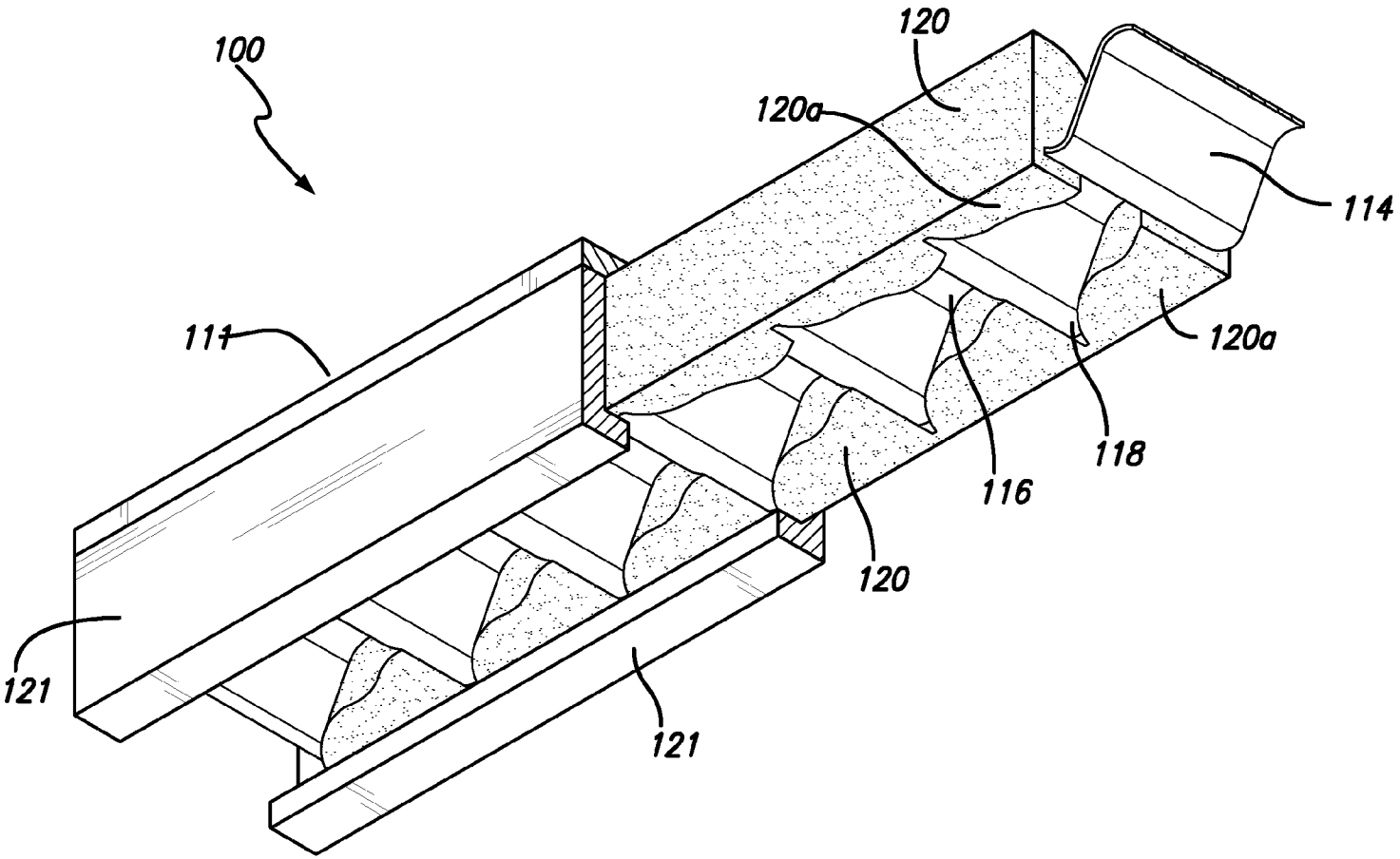
FIG. 2 is a partially broken bottom perspective view of a first version of a spacer having features of FIG. 1.
Figure 3:
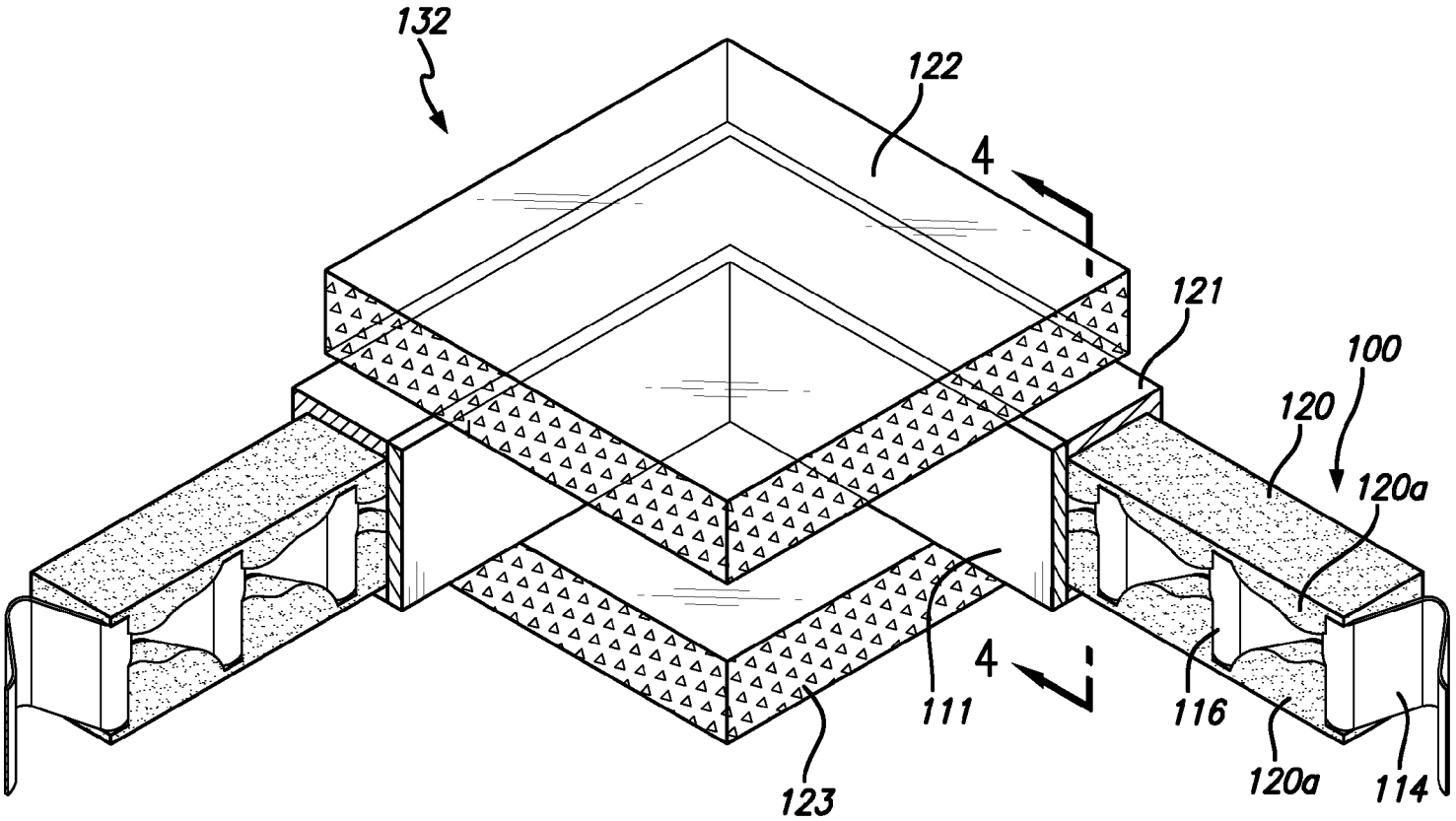
FIG. 3 is a partially broken perspective view of a first version of a spacer having features of FIG. 1 in a window assembly.
Figure 4:
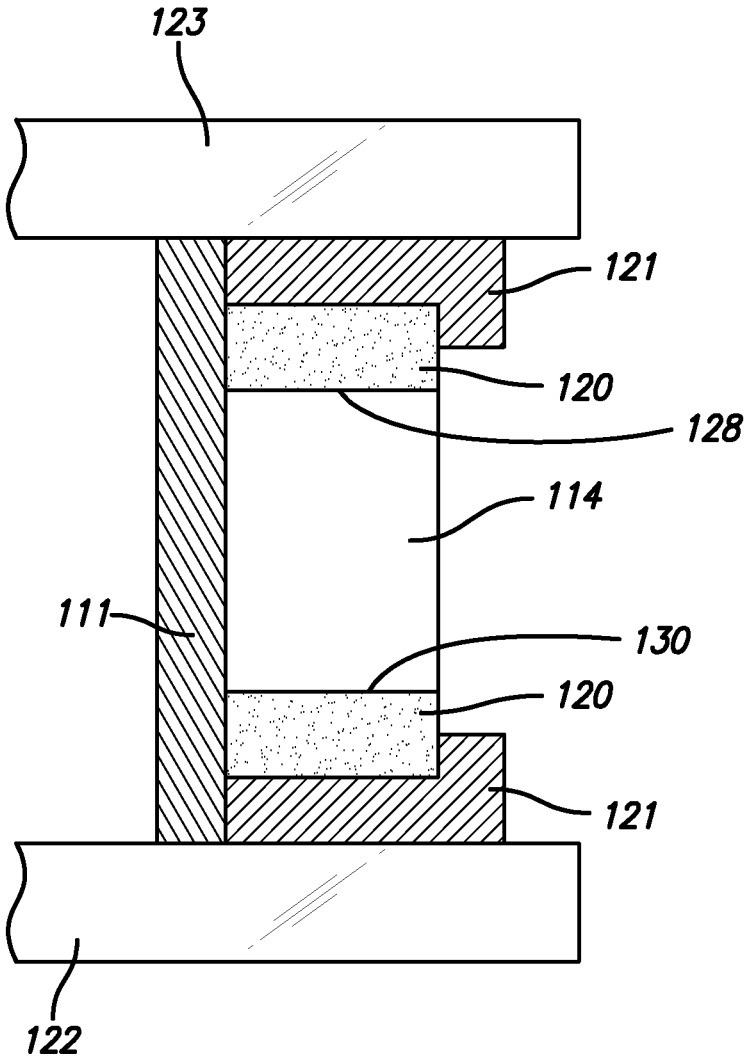
FIG. 4 is a cross sectional view of the window assembly of FIG. 3.

FIGS. 1 and 2 depict a spacer 100 comprising an elongated, flexible strip 114 having an opposed first edge surface 124 and a second edge surface 126 which undulates with crests 116 and troughs 118. The flexible strip also has an opposed first side surface 128 and second side surface 130. FIGS. 3 and 4 depict a window assembly 132 wherein the spacer 100 is used to space apart a first window pane 122 and a second window pane 123.

The first and second side surfaces 128, 130 of the flexible strip 114 are rigid in order to resist compressive forces from the window panes 122, 123, while the edge surfaces 124, 126 are sufficiently flexible to bend. The flexible strip 114 can be made of any rigid material, such as, for example, plastic such as polycarbonate (PC) or polyethylene terephthalate (PET), or a metal such as aluminum.

The spacer 100 also comprises an activatable sealant 120 for directly sealingly securing the flexible strip 114 to each of the two window panes, wherein the activatable sealant 120 completely covers the opposed side surfaces 128, 130 of the flexible strip 114, as shown in FIGS. 1 and 2. An advantage of having an activatable sealant 120 which completely covers the side surfaces 128, 130 of the flexible strip 114 is that there is better contact between the activatable sealant 120 and the flexible strip 114, which increases the overall stability of the spacer 100 when it is used to space apart two window panes 122, 123.

Suitable materials for the activatable sealant 120 can be, for example, a polymer, a resin, or synthetic rubber. Preferably, the activatable sealant 120 is butyl rubber.

The thickness of the activatable sealant 120 on the side surfaces 128, 130 of the elongated flexible strip 114 preferably is sufficient to maintain a continuous seal between the spacer 100 structure and the two window panes 122, 123. However, the activatable sealant 120 cannot be so thick that it causes substantial distortion of the spacer 100 under applied compressive forces. There is also an extended sealant section 120*a* which extends from the periphery of the side surfaces 128, 130, at least towards the middle of the flexible strip 114. An advantage of having an activatable sealant 120*a* which extends towards the middle of the flexible strip 114 is better adhesion between the spacer 100 and the first and second window panes 122, 123.

The extended sealant section 120*a* extends from about 0.1 to about 4 mm from the periphery of the side surfaces 128, 130 at least towards the middle of the flexible strip 114. Preferably, the thickness of the extended sealant section 120*a* from the periphery of the side surfaces 128, 130 towards the middle of the flexible strip 114 is from about 1 mm to about 2 mm. More preferably, the extended sealant section 120*a* extends at least about 1 mm from the side surfaces 128, 130 towards the middle of the flexible strip 114.

The spacer 100 can also contain a desiccant 111 adhered to the second edge surface 126 of the elongated flexible strip 114. The desiccant 111 removes moisture and optionally organic material from the space between the first and second window panes 122, 123. The desiccant can be, for example, silica, activated charcoal, calcium sulfate, calcium chloride, molecular sieves, or a combination of one or more desiccants.

It is also contemplated that the window assembly system has a second version of a spacer 150, as shown in FIGS. 5-8. The second version of the spacer 150 is similar to the first version of the spacer 100, with the addition of a substantially flat strip 110 adhered to the extended sealant section 120*a* and the crests 116 of the second edge surface 126 of the flexible strip 114. The substantially flat strip 110 can be made out of any rigid material such as metal. A metal that can be used is, for example, aluminum. The substantially flat strip 110 can also contain a desiccant 111 adhered to the substantially flat strip 110.

Method of Making the Spacer

The invention is also directed to a method for making the spacer 100 or second version of the spacer 150 described above. In one aspect, the method can be a one-step method for forming the spacer 100 or second version of the spacer 150. In another aspect, the method can be a two-step method for forming the spacer 100 or second version of the spacer 150.

For the one-step method, an activatable sealant 120, such as, for example, a hot melt sealant butyl rubber, is extruded by an extruder on the two opposed side surfaces 128, 130 of the flexible strip 114. The activatable sealant 120 is then activated to allow the sealant to flow into the troughs 118 and crests 116 of the flexible strip 114, extending as an extended sealant section 120*a* from the periphery of the side surfaces 128, 130, at least towards the middle of the flexible strip 114.

Activating the activatable sealant 120 comprises applying pressure and/or heat to the activatable sealant 120. The pressure applied to the activatable sealant 120 is at least 0.1 kilogram per square meter, and the temperature applied is at least 70° C. The activatable sealant 120 is then cooled to room temperature.

Simultaneously with the extrusion of the activatable sealant 120 on the two opposed side surfaces of the elongated flexible strip 114, the desiccant 111 is extruded on top of and adhered to the edge surface of the flexible strip 114. During extrusion, the temperature of the extruder is 80° C. to 90° C. After extrusion, the spacer is cooled to room temperature.

For the second version of the spacer 150, a substantially flat strip 110 is adhered to the crests 116 of the second edge surface 126 of the flexible strip 114 with an adhesive 112. An adhesive 112 can be any material that allows the substantially flat strip 110 to adhere to the flexible strip 114. For example, the adhesive 112 can be hot melt sealant butyl rubber.

Next, the flexible strip 114 is placed on the adhesive 112, joining the substantially flat strip 110 to the second edge surface 126 of the flexible strip 114. A pressure of between 0.5 and 1.0 kilograms per square meter is applied to the substantially flat strip 110/flexible strip 114 structure to allow the structure to adhere. The activatable sealant 120 can be applied either before or after the substantially flat strip 110/flexible strip 114 structure is formed.

Another aspect of the invention is a two-step method for forming the spacer 100 or second version of the spacer 150. The method includes the steps of the one-step method above, with the following additional steps. After the first portion of the activatable sealant 120 is allowed to cool, a second portion of the activatable sealant 121 is extruded by an extruder on the two opposed side surfaces 128, 130 of the flexible strip 114 in contact with the first portion of the activatable sealant 120. In one embodiment, the first portion of the activatable sealant 120, is joined to the second portion of the activatable sealant 121 by applying pressure and/or heat to the spacer 100 or second version of the spacer 150.

Simultaneously with the extrusion of the second portion of activatable sealant 121, the desiccant 111 is adhered to the surface of the substantially flat strip 110 as described above. During extrusion, the temperature of the extruder is 80° C. to 90° C. After extrusion, the spacer 100 or second version of the spacer 150 is cooled to room temperature.

Window Assembly and Method of Making

Figure 5:
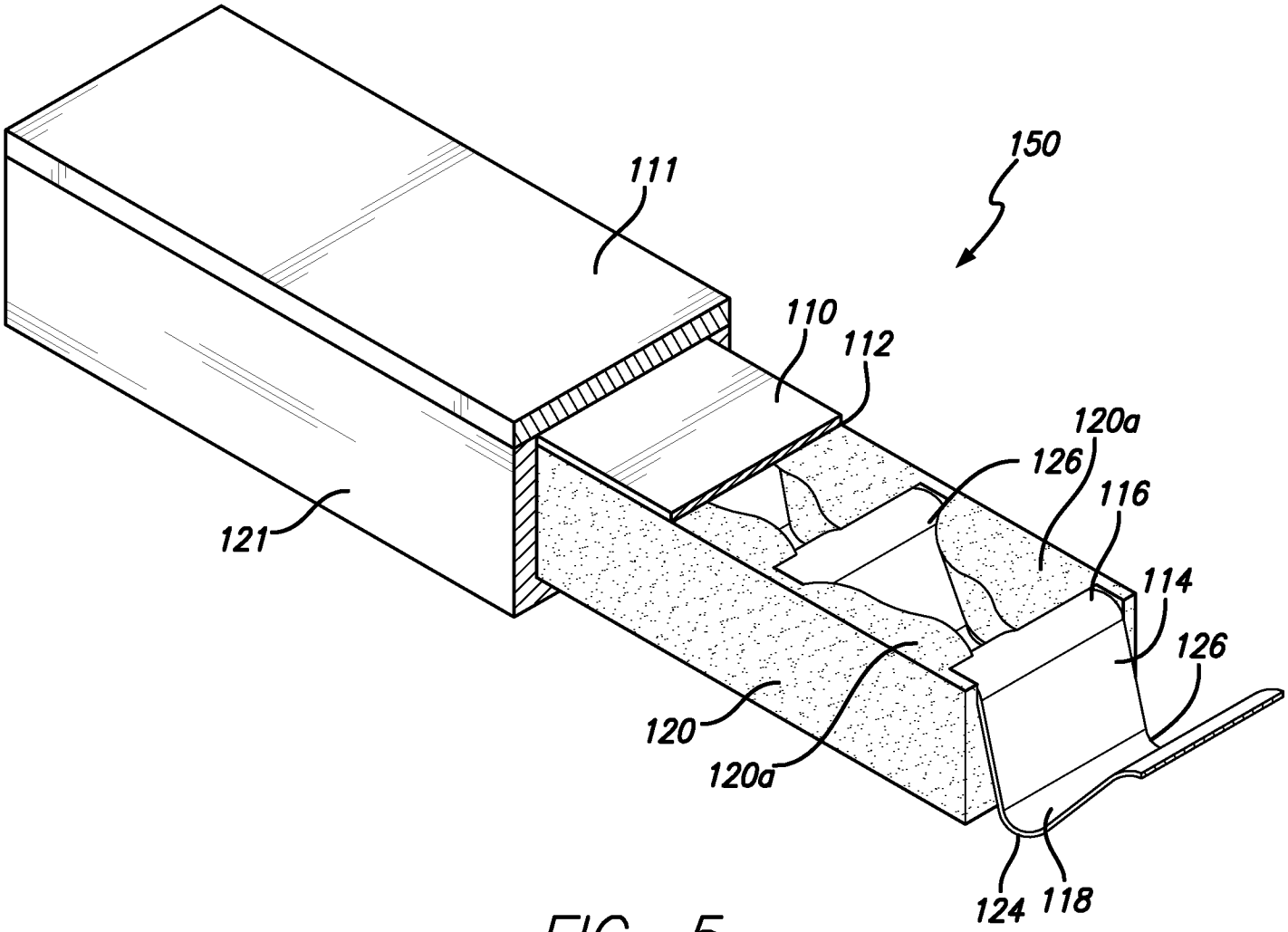
FIG. 5 is a partially broken top perspective view of a second version of a spacer.
Figure 6:
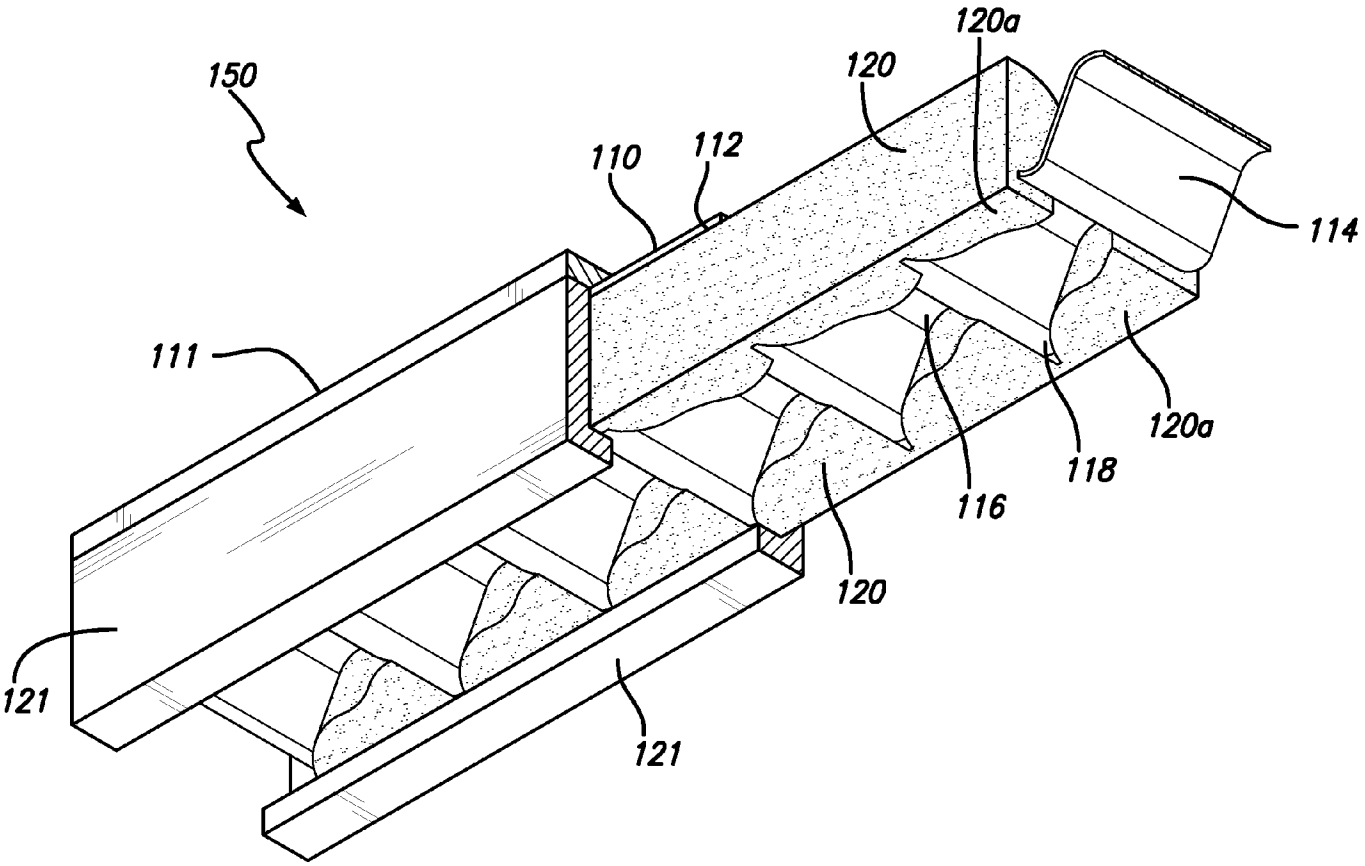
FIG. 6 is a partially broken bottom perspective view of a second version of a spacer having features of FIG. 5.
Figure 7:
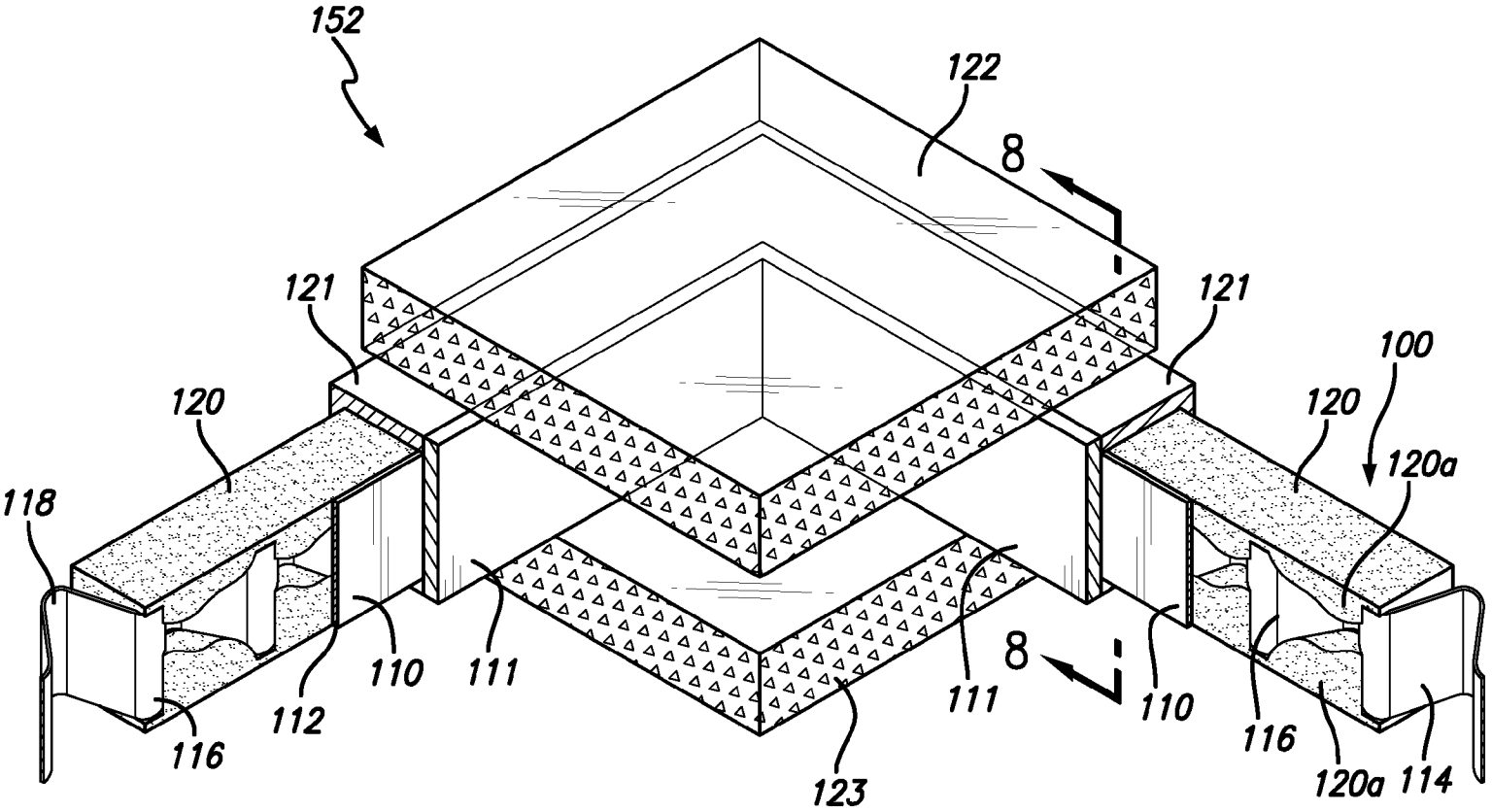
FIG. 7 is a partially broken perspective view of a second version of a spacer having features of FIG. 5 in a window assembly.

The spacer 100 or second version of the spacer 150 described above can be placed between two or more objects in order to space the objects apart and make an assembly such as, for example, a window assembly 132 or 152. In the window assembly 132 or 152, a first window pane 122 and second window pane 123 are spaced apart by the spacer 100, as shown in FIG. 4, or second version of the spacer 150, as shown in FIG. 5.

The first and second window panes 122, 123 can be any surfaces that are made out of a material such as glass, plastic, or Plexiglas. The window panes 122, 123 can be made out of the same material or different material. In one embodiment, the window panes 122, 123 spaced apart by the spacer 100 or second version of the spacer 150 are glass panes.

Figure 8:
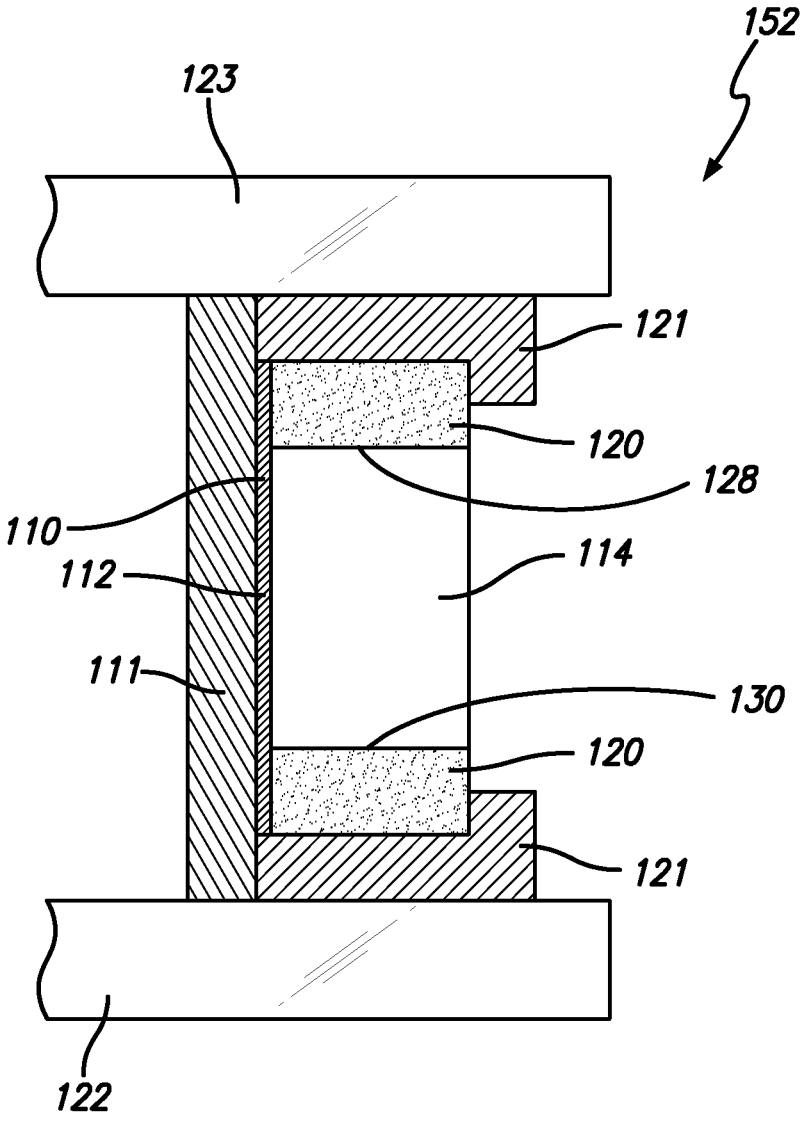
FIG. 8 is a cross sectional view of the window assembly of FIG. 7.

The orientation of the spacer 100 is such that the side surfaces 128, 130 of the flexible strip 114 come into contact with the window panes 122, 123. The spacer 100 is able to resist substantial compressive forces exerted upon it in a direction perpendicular to the surface of the window panes 122, 123. As shown in FIGS. 4 and 8, the desiccant 111 is oriented towards the inside of the window assembly 132 or 152.

The invention includes a method for forming a window assembly 132 or 152 comprising a spacer 100 and two window panes 122, 123 sealingly adhered to the opposed side surfaces 128, 130 of the spacer 100 or second version of the spacer 150 by the activatable sealant 120. The method comprises placing the spacer 100 or second version of the spacer 150 between the two window panes 122, 123, adhering the spacer 100 or second version of the spacer 150 to the two window panes 122, 123 by heating the activatable sealant to at least 70° C. and/or applying pressure of at least 0.1 kilograms per square meter.

Figure 9A:
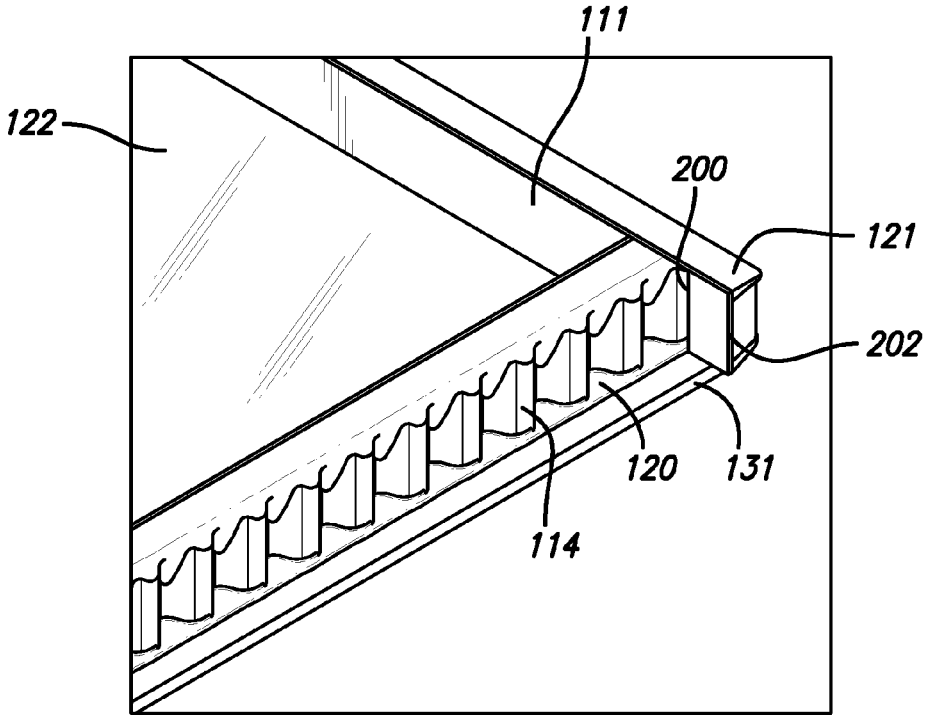
FIGS. 9A-9C is a portion of the window assembly of FIG. 3 showing sequential steps for forming the window assembly.
Figure 9B:
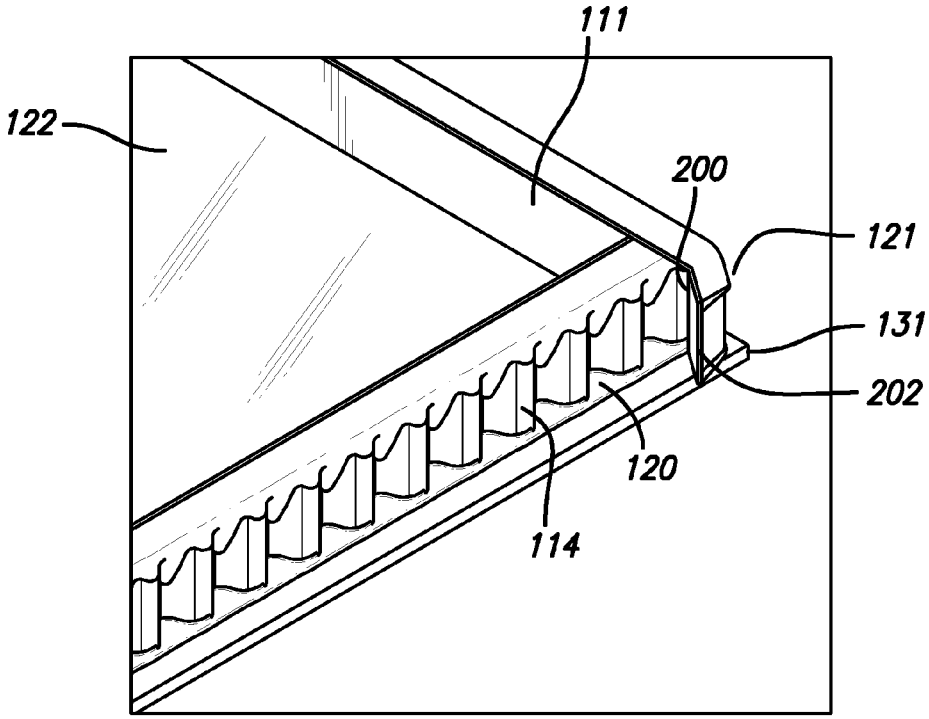
Figure 9C:
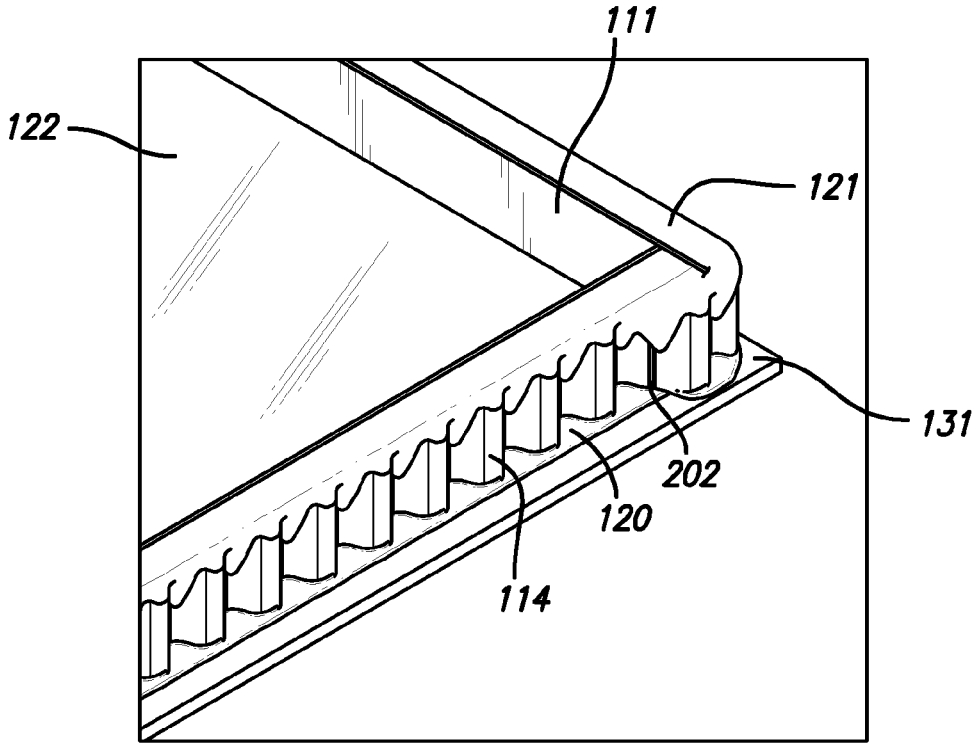

FIGS. 9A-9C depict the method used to form a window assembly 132. In order to form the continuous spacer 100 at a corner 131 of the window assembly 132, a first end 200 of the spacer 100 is placed on one corner of the first window pane 122. The spacer 100 is then placed around the four sides and three edges of the first window pane 122 until a second end 202 of the spacer 100 extends past the first end 200 of the spacer 100, as shown in FIG. 9A. The second end 202 of the spacer 100 is then folded on top of the first end 200 of the spacer 100 as shown in FIG. 9B. Pressure is applied to the overlapping ends of the spacer 100, sealingly adhering the spacer 100 to itself.

The second window pane 123 is then placed on top of the first substantially parallel pane 122 and spacer 100, forming a sandwich structure. To ensure that the first and second substantially parallel panes 122, 123 and the spacer 100 are adhered securely together, pressure and/or temperature is then applied to the entire window assembly 132. In the window assembly 132, the space between the window panes 122, 123 is sealed from the atmosphere, and the air can be removed from the space. A gas such as argon can be introduced in the space between the window panes 122, 123.

The method of assembling a glass window assembly 132 can be used to manufacture new or replacement windows with two or more panes of glass. A triple-paned glass window assembly can also be made by repeating the steps above with a second spacer 100 and a third window pane.

EXAMPLE

A spacer was manufactured using the following method. First, hot melt butyl rubber was extruded on the surface of the substantially flat strip made of aluminum metal using an extruder at 74° C., and a die at 176° C.

Second, the flexible strip, made out of corrugated aluminum, was placed on the butyl rubber on the substantially flat strip. A pressure of between 0.5 and 1.0 kilograms per square meter was applied to the substantially flat strip/butyl rubber/flexible strip structure.

Third, hot melt butyl rubber was extruded into the two opposed side surfaces of the flexible strip and into the interstitial spaces of the flexible strip made by the crests and troughs of the flexible strip.

The activatable sealant was adhered to the entire side surface of the flexible strip and extended into the interstitial spaces of the flexible strip at a distance of approximately 2-3 mm from the side of the flexible strip using an extruder at 74° C., and a die at 176° C. After extrusion, the spacer was cooled to 28° C.

After cooling, hot melt butyl rubber was extruded on one edge surface of the elongated flexible strip/butyl rubber structure using an extruder at 82° C., and a die at 155° C.

Simultaneously with the extrusion of the butyl rubber on the edge of the flexible strip, a desiccant was extruded on top of and adhered to the surface of the substantially flat aluminum strip using an extruder at 83° C., and a die at 183° C. After extrusion, the structure was cooled to 35-38° C.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A method for forming a spacer for spacing apart two window panes, the method comprising the steps of:

(a) adhering an inner surface of a substantially flat strip to an elongated strip having opposed side surfaces and interstitial spaces;

(b) extruding a first activatable sealant on the opposed side surfaces of an elongated strip, wherein the first activatable sealant extends into at least a portion of the interstitial spaces of the elongated strip;

(c) activating the first activatable sealant, whereby the activation causes the first activatable sealant to extend into the at least a portion of the interstitial spaces of the elongated strip;

(d) after step (c), extruding a second activatable sealant for directly sealingly securing the elongated strip to each of the two window panes, the second activatable sealant being in contact with the first activatable sealant, wherein the second activatable sealant is applied separately from the first activatable sealant; and (e) extruding a desiccant on one edge surface of the substantially flat strip.

2. The method of claim 1, wherein step of activating the first activatable sealant is by heating the first activatable sealant to at least 70° C. and applying pressure of at least 0.1 kilograms per square meter.

3. The method of claim 1, wherein the step of activating the first activatable sealant comprises applying pressure of at least 0.1 kilograms per square meter to the first activatable sealant.

4. The method of claim 1, wherein the step of activating the first activatable sealant comprises applying a temperature of at least 70° C. to the first activatable sealant.

* * * * *